US008196661B2

(12) United States Patent
Kaiser et al.

(10) Patent No.: US 8,196,661 B2
(45) Date of Patent: Jun. 12, 2012

(54) METHOD FOR PROVIDING A PREFERENTIAL SPECIFIC INJECTION DISTRIBUTION FROM A HORIZONTAL INJECTION WELL

(75) Inventors: Trent Michael Victor Kaiser, Edmonton (CA); Daniel Dall'Acqua, Edmonton (CA); Morgan Douglas Allen, Edmonton (CA); Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 226 days.

(21) Appl. No.: 12/525,055

(22) PCT Filed: Jan. 29, 2008

(86) PCT No.: PCT/CA2008/000135

§ 371 (c)(1),
(2), (4) Date: Feb. 2, 2010

(87) PCT Pub. No.: WO2008/092241

PCT Pub. Date: Aug. 7, 2008

(65) Prior Publication Data

US 2010/0126720 A1 May 27, 2010

Related U.S. Application Data

(60) Provisional application No. 60/887,133, filed on Jan. 29, 2007.

(51) Int. Cl.
*E21B 43/16* (2006.01)
*E21B 43/24* (2006.01)

(52) U.S. Cl. ..... 166/305.1; 166/272.7; 166/302

(58) Field of Classification Search ..... None
See application file for complete search history.

(56) References Cited

U.S. PATENT DOCUMENTS

| | | | |
|---|---|---|---|
| 4,081,028 | A | 3/1978 | Rogers |
| 4,099,563 | A | 7/1978 | Hutchison |
| 4,399,865 | A | 8/1983 | Anderson |
| 4,410,216 | A | 10/1983 | Allen |
| 4,577,691 | A | 3/1986 | Huang |
| 4,595,057 | A | 6/1986 | Deming |
| 4,640,355 | A | 2/1987 | Hong |
| 4,646,828 | A | 3/1987 | Schwab, Jr. |
| 4,648,455 | A | 3/1987 | Luke |

(Continued)

FOREIGN PATENT DOCUMENTS

| | | | |
|---|---|---|---|
| CA | 1225020 | A1 | 8/1987 |

(Continued)

*Primary Examiner* — Zakiya W Bates
(74) *Attorney, Agent, or Firm* — Chistensen O'Connor Johnson Kindness PLLC

(57) ABSTRACT

A method for distributing injection fluid in a horizontal well bore in fluid communication with hydrocarbon bearing formation begins by determining flow resistance characteristics of the formation along at least a portion of the length of the horizontal well bore. An injection tubing string having a sidewall defining a tubing bore is injected into the horizontal well bore. The tubing string is provided with ports having a selected distribution and geometry. The annulus geometry is selectively controlled along the length of the tubing string through at least one of axial distribution of eccentricity and flow area of the annulus, so as to provide selected flow restriction characteristics along the annulus, such that when injection fluid is pumped into the tubing, a resulting flow resistance network is formed by the tubing bore, the ports, the annulus and the formation, resulting in a desired distribution of the fluid into the formation.

18 Claims, 7 Drawing Sheets

U.S. PATENT DOCUMENTS

| | | | | |
|---|---|---|---|---|
| 4,673,039 | A | 6/1987 | Mohaupt | |
| 4,711,304 | A | 12/1987 | Boeke | |
| 4,770,244 | A | 9/1988 | Webb | |
| 4,921,044 | A | 5/1990 | Cooksey | |
| 5,014,787 | A | 5/1991 | Duerksen | |
| 5,024,274 | A | 6/1991 | Schwab, Jr. | |
| 5,123,485 | A | 6/1992 | Vasicek | |
| 5,141,054 | A | 8/1992 | Alameddine | |
| 5,211,240 | A | 5/1993 | Gadelle | |
| 5,464,059 | A | 11/1995 | Kristiansen | |
| 5,607,018 | A | 3/1997 | Schuh | |
| 5,803,178 | A | 9/1998 | Cain | |
| 5,826,655 | A | 10/1998 | Snow | |
| 5,896,928 | A | 4/1999 | Coon | |
| 5,924,475 | A | 7/1999 | Beckwith | |
| 6,056,050 | A | 5/2000 | Snow | |
| 6,112,817 | A | 9/2000 | Voll | |
| 6,158,510 | A | 12/2000 | Bacon | |
| 6,202,748 | B1 | 3/2001 | Carisella | |
| 6,237,683 | B1 | 5/2001 | Pringle | |
| 6,253,853 | B1 | 7/2001 | George | |
| 6,260,622 | B1 | 7/2001 | Blok | |
| 6,371,210 | B1 | 4/2002 | Bode | |
| 6,457,533 | B1 | 10/2002 | Metcalfe | |
| 6,533,038 | B2 | 3/2003 | Venning | |
| 6,543,538 | B2 | 4/2003 | Tolman | |
| 6,619,397 | B2 | 9/2003 | Coon | |
| 6,622,794 | B2 | 9/2003 | Zisk, Jr. | |
| 6,644,412 | B2 | 11/2003 | Bode | |
| 6,708,763 | B2 | 3/2004 | Howard | |
| 6,883,613 | B2 | 4/2005 | Bode | |
| 6,907,936 | B2 * | 6/2005 | Fehr et al. | 166/387 |
| 7,032,665 | B1 * | 4/2006 | Berrier | 166/278 |
| 7,032,675 | B2 | 4/2006 | Steele | |
| 7,059,401 | B2 | 6/2006 | Bode | |
| 7,124,830 | B2 | 10/2006 | Metcalfe | |
| 2003/0062170 | A1 | 4/2003 | Slack | |
| 2004/0065445 | A1 | 4/2004 | Abercrombie Simpson | |
| 2005/0150657 | A1 | 7/2005 | Howard | |
| 2007/0012454 | A1 | 1/2007 | Ross | |
| 2008/0251255 | A1 | 10/2008 | Forbes | |

FOREIGN PATENT DOCUMENTS

| | | | |
|---|---|---|---|
| CA | 2054780 | A1 | 5/1992 |
| CA | 2054818 | A1 | 5/1992 |
| CA | 1303972 | C | 6/1992 |
| CA | 2058108 | A1 | 6/1992 |
| CA | 1327744 | C | 3/1994 |
| CA | 2219513 | A1 | 5/1999 |
| CA | 2254244 | A1 | 10/1999 |
| CA | 2292278 | A1 | 6/2001 |
| CA | 2418195 | A1 | 7/2004 |
| WO | 93/25800 | A1 | 12/1993 |

* cited by examiner

FIG. 1 – PRIOR ART

FIG. 2 – PRIOR ART

METHOD FOR PROVIDING A PREFERENTIAL SPECIFIC INJECTION DISTRIBUTION FROM A HORIZONTAL INJECTION WELL

FIELD

The present method is directed towards the improved recovery of hydrocarbons from subterranean formations. More specifically the present method relates to a method of providing a preferential injection distribution in to a permeable formation from a horizontal well bore.

BACKGROUND

One process commonly used for in-situ recovery of highly viscous "tar-sand" based hydrocarbons (bitumen) is steam assisted gravity drainage (SAGD). SAGD relies on pairs of horizontal wells arranged such that one of the pair of horizontal wells, called the producer, is located below the second of the pair of wells, called the injector. Recovery of bitumen is accomplished by injecting steam into the injector wellbore. The steam then proceeds from the injector wellbore into the hydrocarbon bearing formation where it creates a steam chamber. As steam is continuously injected into the formation, it enters the steam chamber, migrates to the edge of the steam chamber and condenses on the interface between the chamber and bituminous formation. As the steam condenses, it transfers energy to the bitumen, which improves its mobility by heating it up and decreasing its viscosity. The mobile bitumen and condensed water flows down the edges of the steam chamber and into the producer wellbore. The fluid mixture that enters the producer well is then produced to surface.

One strategy used for preferred injection distribution of steam is to use a slotted liner with a low open area. In this strategy, the active mechanism for providing the improved injection fluid distribution is an increased radial flow resistance due to near well bore divergence losses.

Another strategy is to use a technique called "limited entry". This technique involves injecting steam into a tubing string which is inside the substantially perforated liner of an injection well. The tubing string is equipped with a limited number of distributed perforations. The active mechanism in this strategy is utilization of the choked-flow phenomenon which limits mass-flow velocity through a restriction to sonic velocity.

SUMMARY

There is therefore provided a method for distributing injection fluid in a horizontal well bore in fluid communication with hydrocarbon bearing formation comprises determining flow resistance characteristics of the formation along at least a portion of the length of the horizontal well bore. An injection tubing string having a sidewall defining a tubing bore is injected into the horizontal well bore. An annulus is defined between the horizontal well bore and the tubing string, the tubing string being provided with ports having a selected distribution and geometry communicating fluid between the tubing bore and the annulus. The annulus geometry is selectively controlled along the length of the tubing string through at least one of axial distribution of eccentricity and flow area of the annulus, so as to provide selected flow restriction characteristics along the annulus, such that when injection fluid is pumped into the tubing, a resulting flow resistance network is formed by the tubing bore, the ports, the annulus and the formation, resulting in a desired distribution of the fluid into the formation.

According to another aspect of the method, a preferential injection distribution of steam and heat from a horizontal well bore into a subterranean formation is provided. Initially, a horizontally oriented well is drilled into the formation. Next an apparatus according to the present invention is installed in the well bore. Steam is then supplied to the apparatus such that it provides a preferential distribution to the subterranean formation. The preferential distribution of steam may be uniform or it may be directed to the preferential recovery of hydrocarbons by targeting injection to areas of specific formation permeability or depletion history.

According to another aspect of the method, a first step includes determining the preferential distribution of injected fluid along the length of the horizontally positioned wellbore. A second step includes configuring the injection apparatus to deliver the preferential distribution of injection fluid by determining the appropriate sizing and spacing of injection openings, and the required annular gap. The apparatus consists of a sand control device and a smaller diameter tubular with a plurality of preferentially distributed injection openings positioned within the sand control device for the purpose of distributing fluid within the sand control device. A third step includes positioning the apparatus in a horizontal well bore. A fourth step includes supplying steam to the apparatus for preferential distribution to the well bore.

BRIEF DESCRIPTION OF THE DRAWINGS

These and other features will become more apparent from the following description in which reference is made to the appended drawings. The drawings are for the purpose of illustration only and are not intended, in any way, to limit the scope of the method to the particular embodiment or embodiments shown, wherein.

DETAILED DESCRIPTION

Horizontal injection wells are most effective if the volume of injected steam is preferentially distributed along the length of the horizontal well which allows for creation of a uniform steam chamber along the length of the injector. In some cases the preferential distribution is uniform along the length of the well and in other cases the preferential distribution targets specific sections of the reservoir which are less depleted than other sections. The method described below may be used provide a preferential distribution of steam to a subterranean formation via a substantially horizontally positioned wellbore based on an assessment of the formation characteristics (such as permeability distribution, flow resistance in the formation, and depletion history), and to minimize injection pressures.

Figure 1:
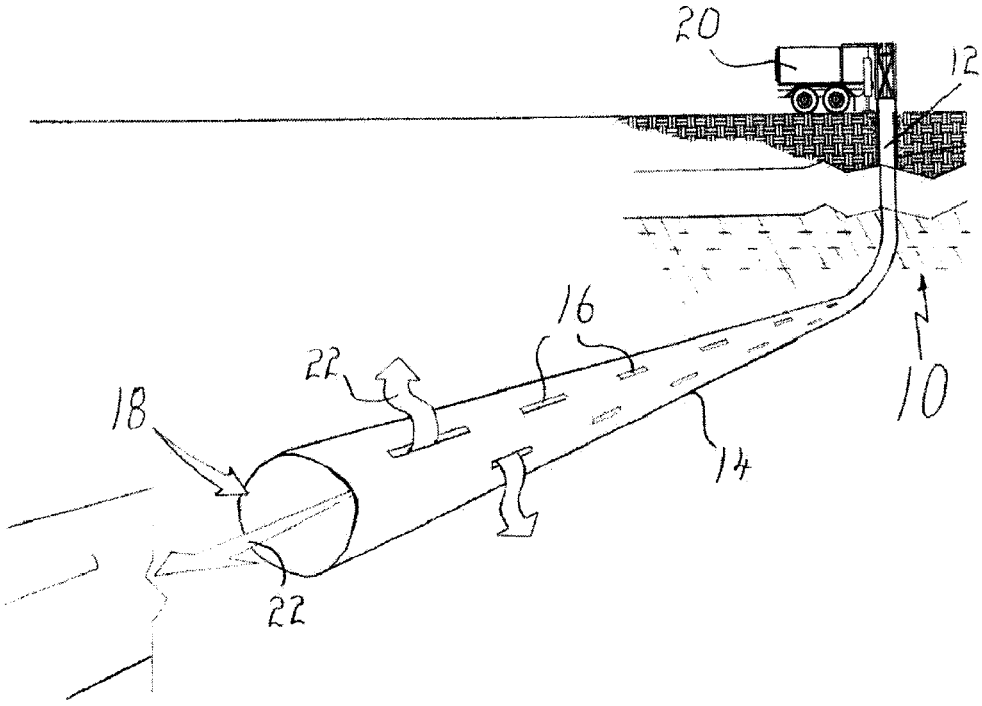
FIG. 1 is a schematic cross-section of a horizontal well bore completed in accordance with the prior art.

Referring to FIG. 1, a prior art steam distribution method is shown. Steam is distributed to the formation 10 through a limited number of slotted perforations 18 in the liner 22. In this strategy, the active mechanism for providing the injection fluid distribution is an increased radial flow resistance due to near well bore divergence losses. As proposed in this strategy the liner has a limited number of slotted perforations that are exposed to the formation. In some cases, slotted perforations exposed to formations consisting of unconsolidated sands are prone to plugging. Where the number of slotted perforations is low, such plugging may limit the injectivity of the well and may have an unfavourable impact on the steam distribution. Thus an alternate strategy is required with more resistance to plugging.

Figure 2:
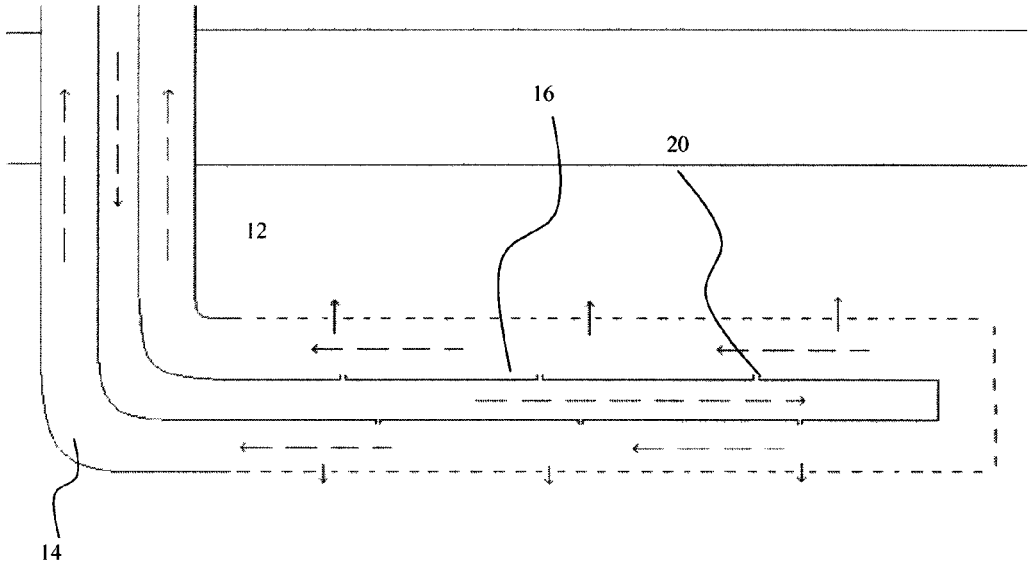
FIG. 2 is a schematic cross-section of a horizontal well bore completed in accordance with the prior art.

Referring now to FIG. 2, another prior art steam distribution method is shown. A horizontal wellbore 14 is shown penetrating a hydrocarbon bearing formation 12. Steam is injected into the wellbore through the tubing string 22 and flows to the horizontal section of the wellbore where it exits the tubing string through perforations 18 in the tubing. The steam injection rate, perforation geometry and perforation quantity are selected such that critical flow will be achieved through the tubing perforations, provided the steam is supplied with sufficient injection pressure such that a critical pressure ratio is achieved between the injection tubing and the annulus. This injection strategy provides uniform steam distribution to the annulus between the liner and the tubing with a large pressure drop between the tubing and the annulus. Preferentially a steam injection strategy would provide an injection distribution tailored to the condition of the formation (such as the depletion of the well, or the flow resistance network) with minimum pressure drop. The "flow resistance" of a formation is related to the ability of a formation to receive fluids injected from the well bore under the action of a pressure differential between the wellbore and the formation pore pressure, and is dependent upon formation properties such as permeability, and any other factors that may contribute to the amount of fluid that can be injected.

Figure 3:
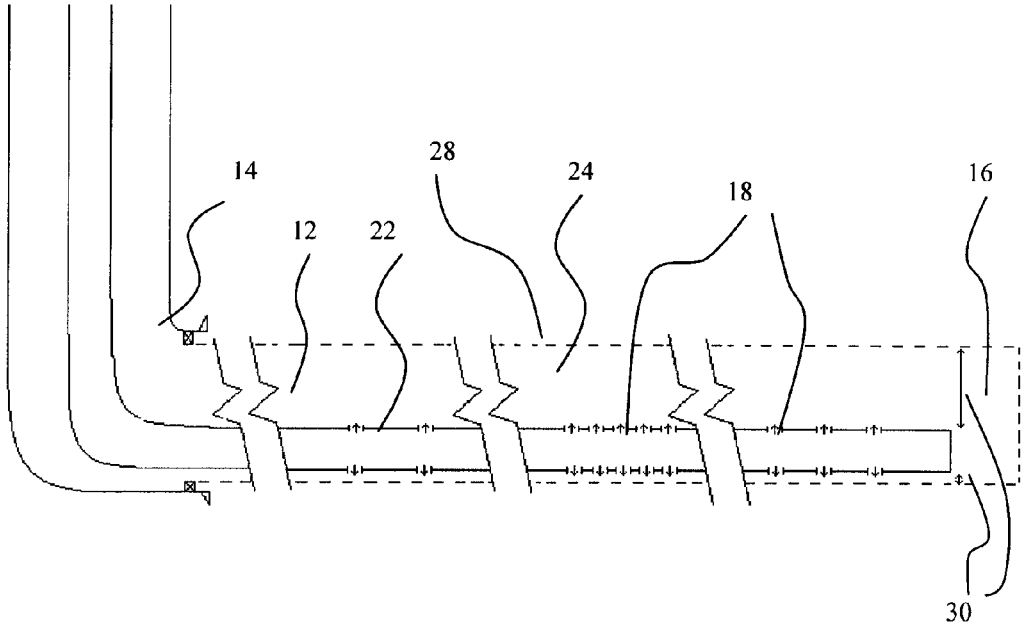
FIG. 3 is a schematic cross-section of a horizontal well bore completed in accordance with the present method.

Referring to FIG. 3, there is provided a preferential injection distribution of steam and heat into a permeable subterranean formation from a horizontal well bore. A horizontal well bore 12 has a heel portion 14 and a toe portion 16. In a first step, the distribution of formation permeability and depletion history is determined along the length, or a target length, of the horizontally positioned wellbore. Using this information, a preferred injection distribution may then be determined. Once the preferred injection distribution has been determined, the injection apparatus can then be configured to deliver the preferred injection distribution by providing selected flow restriction characteristics. This is done by determining the appropriate geometry and spacing of injection openings, and the required annular geometry. The flow resistances introduced by these variables create a flow resistance network in combination with the flow resistance of the formation to achieve the preferred injection distribution. The apparatus consists of a sand control device 28, which is preferentially a slotted liner, and a smaller diameter tubing string 22 with a plurality of preferentially distributed injection ports 18. The ports 18 are distributed non-uniformly to achieve the desired injection distribution. In addition, since it is generally the flow area that is changed to achieve different flow areas for the steam, the size of the perforations 18 may be adjusted along with, or instead of, the perforation density to help achieve the desired injection distribution. Next, the sand control device 28, if used, is positioned in the horizontal well bore. Sand control device 28 may be a slotted liner, a wire-wrap screen, or other design that provides similar results. Injection tubing 22 is then inserted. Alternatively, the well bore 12 may not require a liner 28, in which case tubing string 22 may be inserted directly into well bore 12. Injection tubing 22 has an injection zone with a plurality of preferentially distributed injection openings 18 or perforations, and an outside diameter such that the size of the offset annulus 30 provides preferential redistribution of flow within the annulus. Naturally, tubing 22 will tend to rest on the lower inside surface of the sand control device 28 or well bore 12, so that annulus 30 will be larger on the top than on the bottom. The tubing 22 is installed such that the perforations 18 align with the injection target area of the well. However, the tubing 22 is preferably the full length of the well with a capped end. Once installed, steam is injected along the horizontal well bore 12 through the injection tubing 22. The fluid injection is initiated at surface through the tubing 22, then through the injection openings 18 into the annulus 24 and then into the formation through the sand control device 28. Horizontal injection wells are generally more effective if the injection volume is distributed along the length of the horizontal well. To achieve preferential injection distribution along the length of a horizontal well the radial flow resistance must be balanced with the axial flow resistance in the well. In the case of a tubing conveyed steam distribution apparatus, multiple radial and multiple axial flow resistances must be considered.

When determining how to obtain the preferred injection distribution, the various flow restrictions present in the system, or the flow resistance network, must be considered. In the tubing string 22, there is an axial flow restriction, and a radial flow restriction out of ports 19. In the annulus between tubing string 18 and ether well bore 12 or liner 28, there will be a radial flow restriction into through the liner 28 (if present) and into the formation, as well as an axial flow restriction along the annulus. Finally, there is also a flow restriction within the formation. It will be noted that these restrictions may be non-linear and variable along the length of the annulus. The actual restriction applied will depend on factors such as the fluid pressure, the geometry of the annulus or the ports 18, the flow resistance of the formation, the design of liner 28, etc. Thus, the flow resistance network may be manipulated to provide desired results by controlling certain variables. These variables include: the geometry of the tubing string including the shape and diameter; the geometry, density and position of ports 18; the geometry of the annulus including the size of the annulus, the eccentric position of tubing string 22 within bore 12, and restriction points within the annulus; and the presence or absence of a liner 28, including the geometry and permeability of the liner 28. This list is not intended to be exhaustive, and once the principles discussed herein are understood, other variables may be apparent to those skilled in the art. The details of these factors are discussed below.

With the method described herein, the distribution of flow from the tubular string into the annulus is controlled primarily by the through-wall flow resistance provided by the injection openings on the removable tubular string, the axial variation in pressure along the injection tubing 22, and the pressure differential between the injection tubing 22 and the annulus. Where the number and geometry of injection openings 18 imposes a significant restriction to flow and the cross-sectional area of the removable tubing string is adequate, the pressure distribution in the tubular annulus will be substantially more uniform than the distribution within the removable tubular string. The radial flow resistance of the tubing string and the associated improvement in injection fluid distribution must be balanced with the incremental pressure required to supply the desired flow rate through increased total flow resistance.

Figure 6:
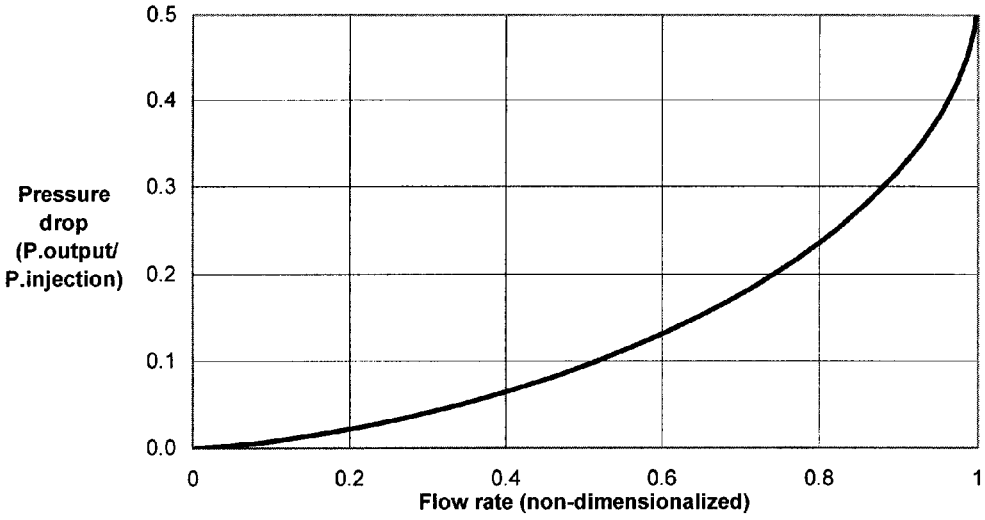
FIG. 6 is a graph showing the non-linear flow-rate pressure loss relationship for a given fluid through a sample injection opening.

If the relationship between flow-rate and pressure drop for fluid flow through injection openings is non-linear such as the example shown in FIG. 6, it may be exploited to further improve the response of the injection system axial. Specifically, such non-linearity may be used to promote rate-independence of the injection distribution, whereby large changes in the total injection rate have minimal impact on the distribution of fluid. Furthermore this can be done without plugging injection openings, because the active distribution injection openings are not exposed to formation material.

Figure 7:
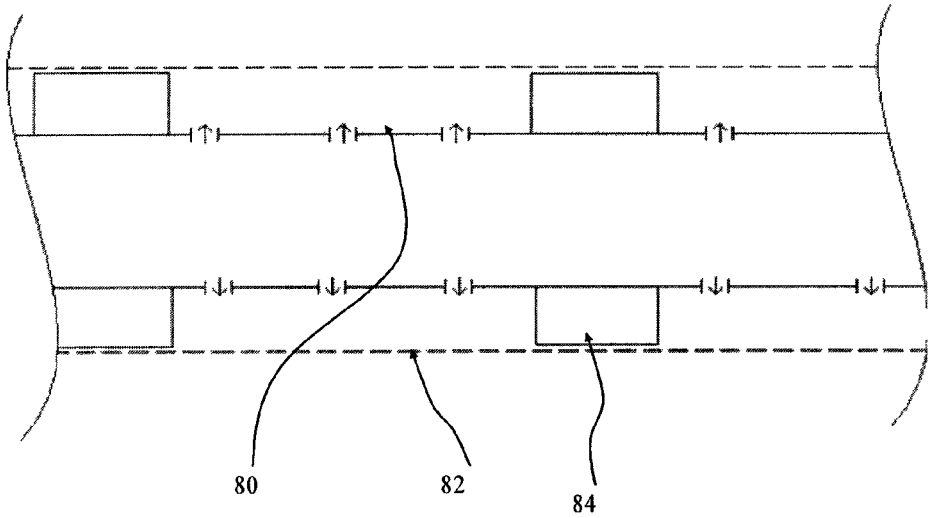
FIG. 7 is a schematic showing a cross-section of a small portion of a completed horizontal well bore wherein the tubing is equipped with discrete annular flow restriction fixturing.

Referring to FIG. 7, injection distribution into the reservoir is further influenced by the size of the annular space between the inner and outer tubulars, or the tubular string 22 and the sand control device 28, respectively. In the presence of axial variations in reservoir flow resistance, a small annular space may be selected to cause the injection distribution to be more independent of reservoir permeability or a larger annular space may be utilized to encourage injection into more permeable regions. The cross-sectional flow area of the annulus, or the geometry of the annulus can be controlled by appropriately selecting the internal diameter of the sand control device 28 and the external diameter of the tubing string 22 such that they provide the desired flow area. The geometry of the annulus refers to the "annular gap", or the cross-sectional flow area between the well bore 12 or liner 28, and the tubing string 22, and need not be consistent along the entire length of the annulus. The geometry of the annular space controls the annular axial flow resistance which controls the tendency of fluid to redistribute along the length of the annulus and into the reservoir. Once the injection fluid has been distributed preferentially throughout the annular space, it can flow radially into the formation or it can further distribute itself throughout the annulus, depending on the flow resistance of the formation.

Various means may be provided to selectively control the annulus flow area. Examples of these include selection of the inside diameter of well bore 12 or liner 28 along the horizontal well length. Where no liner is used, in so called barefoot completions, selection of bit size combined with selectively under reaming may be used to control bore hole diameter, as is known in the art. Where liner 28 is used, the liner tubular inside diameter may be selected to provide a constant inside diameter or may be selected to provide intervals of differing diameter. Further means to control annulus flow area may be obtained by providing tubular fixturing 84 at intervals along the tubing string 84, as shown in FIG. 7. Tubular fixturing 84 may be provided in the form of inflatable packers or sleeves attached to the tubular to effectively increase its outside diameter over an interval. It will be apparent that the means used to control the well bore diameter and means used to control the tubing or tubing fixturing outside diameter can be used in combination to provide considerable flexibility in selection of annular area when the tubing string is placed in the well bore and thus controls the annular axial flow resistance which controls the tendency of fluid to redistribute along the length of the annulus and into the reservoir. Once the injection fluid has been distributed preferentially throughout the annular space it can flow radially into the formation or it can further distribute itself throughout the annulus depending on the flow resistance of the formation.

Figure 8:
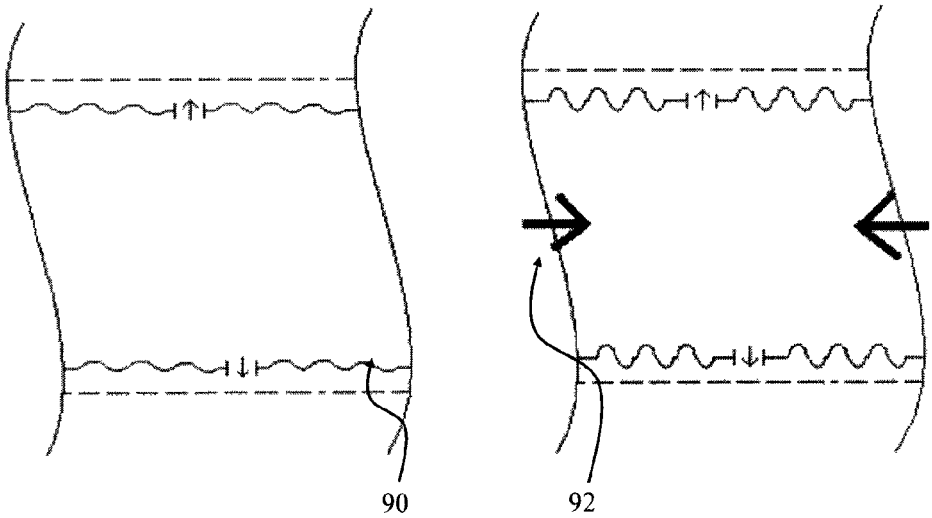
FIG. 8 is a schematic showing cross-sections of a small portion of a completed horizontal well bore wherein the tubing is provided with corrugations.

With reference to FIG. 8, a further means to selectively control annular flow area may be obtained by providing corrugations 90 in the tubing wall. Under application of sufficient compressive axial load 92, the corrugations can be made to expand radially providing a means to selectively reduce the annulus flow area while the string is disposed in the well bore. It will be apparent that the application of axial tension load provides a means to increase the annulus flow area.

Figure 9:
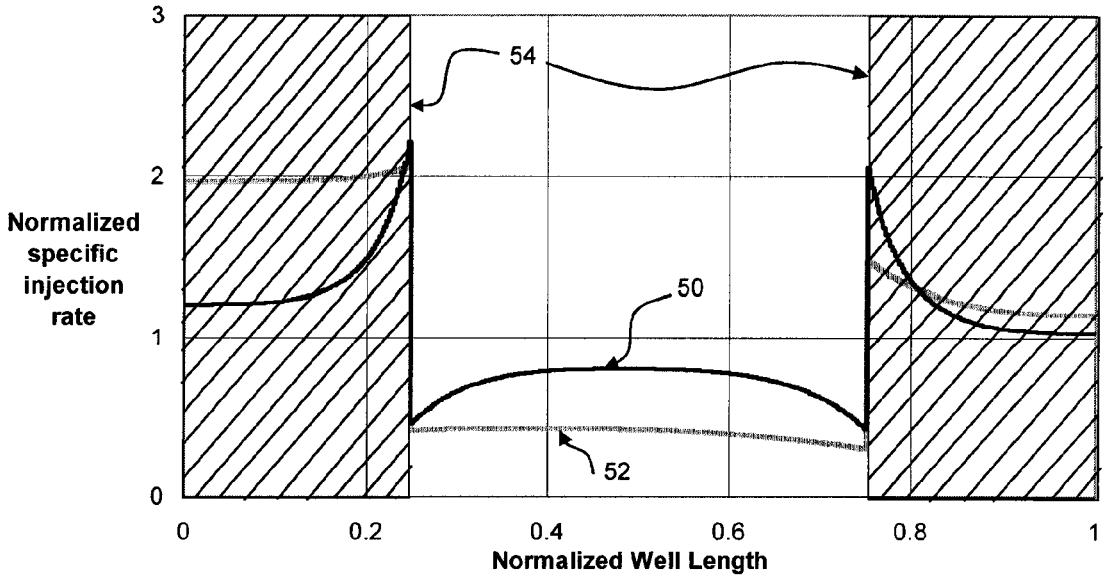
FIG. 9 is a graph which demonstrates the effect of axial annular flow resistance on specific injection rate.

An example of a situation where it would be desirable to narrow the annular gap would be where the well bore 12 being completed had axial non-uniformity in its flow resistance. In this situation, annulus geometry control would be exercised to make the annulus relatively narrow so that more of the injection fluid is forced to flow radially into the formation because the axial resistance to annular flow has been increased. By making the annulus smaller, more of the injection fluid is forced to flow radially into the formation because the axial resistance to annular flow has been increased. FIG. 9 shows two sample flow distributions in a reservoir with variable permeability along its length. In this example, the centre section is five times less permeable than the end sections of the formation 54. In this case, the specific injection rate is compared for two different axial annular flow resistances. The curve 52 represents a low annular flow resistance and curve 50 represents a substantially larger annular flow resistance. It is clear from this comparison that by controlling the annular flow resistance, the injection fluid distribution can also be controlled.

An example of a situation where it would be desirable to change the geometry of the annulus by restricting certain points, such as by using tubular fixturing to provide an increase in the axial annular flow resistance at discrete points along the length of the well bore is where certain portions of the formation are to be targeted, or certain portions are to be avoided. For example, if the formation has previously been completed, but the injected fluid was not preferentially distributed, there may be some portions of the formation that it would be beneficial to inject steam into. Alternatively, there may be a "thief zone", or a zone with a low flow resistance that accepts the injected fluid at a lower pressure than other areas, such that the effectiveness of the pressurized fluid is reduced in other areas. Other such situations will be apparent to those skilled in the art.

Slotted tubing perforations provide the preferred geometry for tubing perforations as they are the least sensitive to the proximity of the inside diameter of the sand control device 28. The injection tubing may be resting on the bottom surface of the inside diameter of the sand control device 28 thus restricting injection through perforations aligned with or nearly aligned with the bottom of the injection tubing. In this configuration, the relatively large perimeter to flow area ratio of the slotted perforation decreases the flow restriction caused by the proximity of the inner diameter of the sand control device 28. This allows more accurate prediction of flow characteristics and thus more accurate distribution of steam. Additionally, slotted tubing perforations provide the preferred injection opening geometry because they can be produced economically in a range of quantities and distributions to provide the radial flow control required.

Another advantage of this method is that the preferentially distributed injection openings are located on a retrievable tubing string and as such the tubing string may be cleaned, replaced, modified, or re-positioned at any point in the well life. Similarly, existing injection wells may be re-completed with such an injection string to improve overall injection performance, or to direct injected fluid to regions of the reservoir that were not reached with the original completion strategy. In these situations an understanding of the well history, the permeability distribution and the preferred injection distribution will allow optimal recompletion.

It will be also noted that other factors may be considered when characterizing the well. For example, the well spacing in SAGD operations may be taken into account. In locations where injector and producer wells were closer together, pressure variations along the injection well may be desirable to prevent steam breakthrough to the production well. Another factor includes the evolution of steam chamber/preferential steam chamber growth. If through field measurements, taken using, for example, tiltmeter, microseismic, etc., steam chamber growth is determined not to be ideal, the well can be recompleted with adjusted steam distribution.

Figure 5:
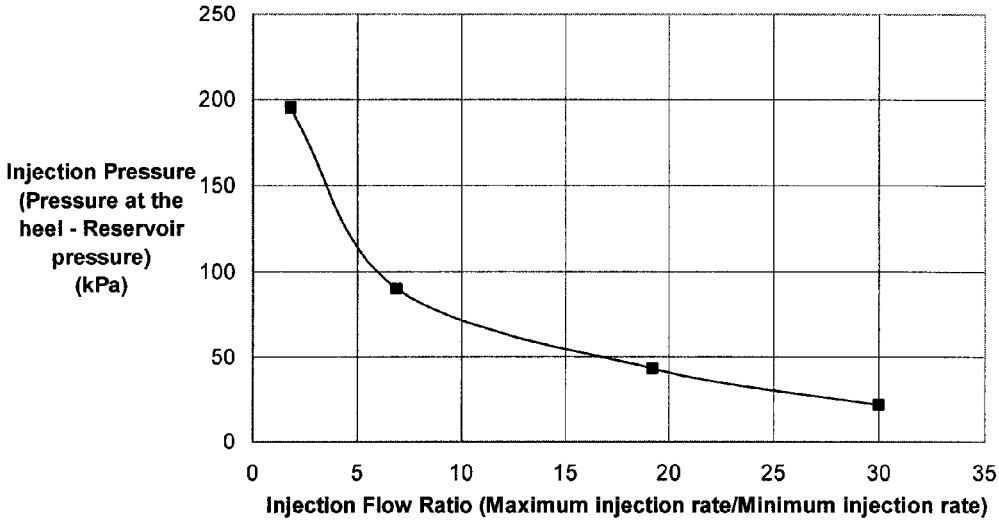
FIG. 5 is a graph showing the pressure increase expected as the flow ratio is improved.

In some instances, the preferred distribution of injection fluid in horizontal well bores is uniform. It has been discussed in the prior art that to achieve uniform distribution, the radial flow resistance for the injection fluid must be increased relative to the axial flow resistance. The trade-off to increasing radial flow resistance is that the injection pressure must be increased in order to supply the equivalent amount of injection fluid to the reservoir. Increasing injection pressure places higher temperature and pressure demands on the fluid injection apparatus. FIG. 5 illustrates the pressure trade-off for a single sample well configuration with a uniform spacing of tubing perforations by comparing the injection pressure (the difference between pressure at the heel of the tubing and the pressure in the reservoir) with the "injection flow ratio", defined as the ratio of maximum to minimum specific injection rate into the reservoir for a sample completion configuration (injection flow ratio). With reference to FIG. 5 the relationship shown is asymptotic to an injection flow ratio of one. This relationship could be further optimized by improved distribution of injection perforations. The preferred injection pressure is a balance between providing a preferential flow distribution and maintaining mechanical and economic feasibility.

Figure 10:
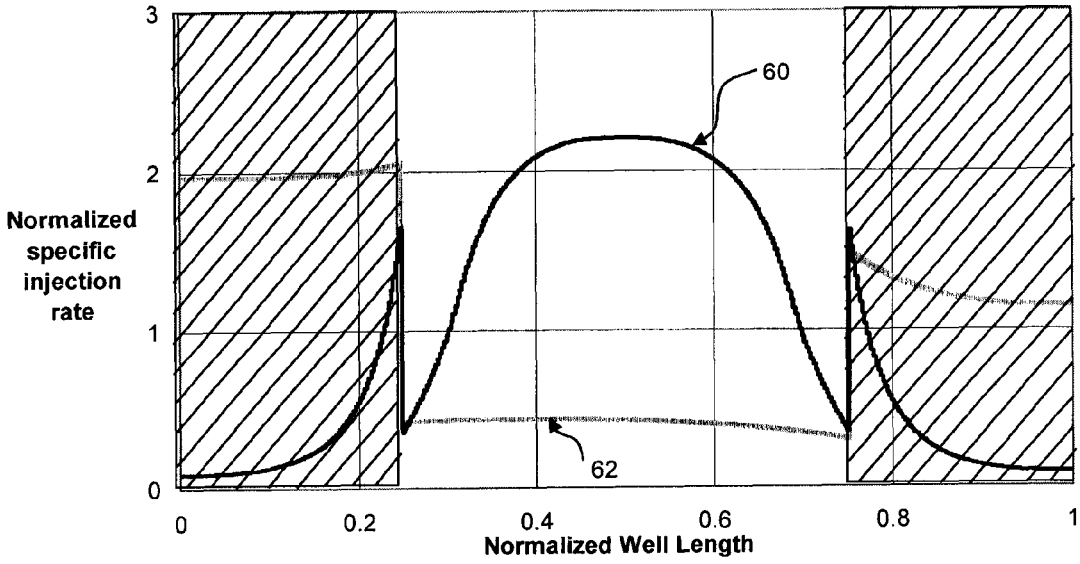
FIG. 10 is a graph which demonstrates the benefit of preferential distribution of tubing injection openings where variable formation permeability exists.

In other instances, the preferred distribution of injection fluid will not be uniform. This may be the case in a situation with variable formation permeability as previously described, wherein the central formation region has permeability five times lower than outer regions. If more fluid injection into the low permeability zone is required, the perforations may be preferentially distributed along the central portion of the well bore. An example of the resulting injection distributions is shown in FIG. 10. The curve 60 shows the specific injection rate in the case where the injection openings are distributed only in the low permeability (center) section of the well and there is high axial annular flow resistance, compared to the base case 62 with substantially evenly distributed injection openings and low axial annular flow resistance. It is clear from FIG. 10 that flow distribution can be controlled by varying the distribution of the injection openings on the tubing string. Additionally, a non-uniform distribution may be useful in situations where the reservoir has previously been depleted in a non-uniform manner and the injection distribution will target less depleted sections of the reservoir.

Figure 4:
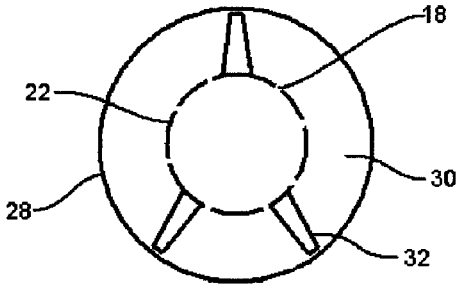
FIG. 4 is an end view in section of a tubing string supported by a centralizer.

In certain cases the flow rate exiting the perforations in the tubing may have high enough velocity that it creates a risk of damage to the inside surface of the sand control device 28 due to impingement. Referring to FIG. 4, the preferred method of preventing impingement is to use rigid fixed centralizers 32 on the tubing 22. The centralizers would be located at positions corresponding to the perforations 18 in the tubing 22 and would prevent direct impingement of steam onto the sand control device 28 and still allow flow between the tubing 22 and annulus 30.

One of the advantages of the method and apparatus described above is that it can be used to provide a preferential injection distribution into a subterranean formation where the injection distribution is largely independent of local variations in formation permeability. Another advantage is that it can be used to provide a preferential injection distribution into a subterranean formation where the preferential injection distribution is not uniform.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

We claim:

1. A method for distributing radial fluid flow between a horizontal well bore and a hydrocarbon bearing formation, comprising:

determining that the formation has an axially distributed non-uniform radial flow resistance along a target length of the horizontal well bore;

inserting a tubing string having a sidewall defining a tubing bore into the horizontal well bore, an annulus being defined between the horizontal well bore and the tubing string, the tubing string being provided with ports having a selected distribution and geometry communicating fluid between the tubing bore and the annulus; and controlling the annulus geometry selectively along the length of the tubing string through at least one of axial distribution of eccentricity and flow area of the annulus, so as to provide selected flow restriction characteristics along the annulus, such that when fluid is pumped into the tubing string, a resulting flow resistance network is formed by the tubing bore, the ports, the annulus and the formation, resulting in a desired distribution of radial fluid flow between the well bore and the formation, the annulus geometry being selected on one of the following bases:

to improve the uniformity of distribution of radial fluid flow between the well bore and the formation in the presence of an axially distributed non-uniform radial flow resistance in the formation along the horizontal well bore;

to promote a uniform pressure in the annulus in the presence of an axially distributed non-uniform radial flow resistance in the formation along the horizontal well bore; or to target radial fluid flow into selected formation zones in the presence of an axially distributed non-uniform radial flow resistance in the formation along the horizontal well bore.

2. The method of claim 1, wherein the well bore has a liner allowing fluid communication with the formation over at least one interval.

3. The method of claim 2, wherein centralizers are attached to the tubing string at one or more locations to reduce direct impingement of injection fluid onto the liner.

4. The method of claim 1, wherein the flow restriction characteristics of the ports are non-linear with respect to the flow rate through the ports.

5. The method of claim 4, wherein the port geometry is selected to provide flow restriction characteristics having a positive second derivative of pressure loss with respect to flow rate through the ports over a range of sub-critical flow rates.

6. The method of claim 1, wherein the port geometry is a slot.

7. The method of claim 1, wherein the annulus geometry is selectively controlled through tubing diameter selection.

8. The method of claim 1, wherein the annulus geometry is selectively controlled through the use of tubular fixturing to increase the axial annular flow resistance at selected locations along the length of the tubing string.

9. The method of claim 8, wherein the annulus geometry is selectively controlled through the use of inflatable packers attached to the tubing string, the inflatable packers being attached to the tubing string to effectively increase an outside diameter of the tubing string over an interval.

10. The method of claim 8, wherein the annulus geometry is selectively controlled through addition of sleeves to the tubing string which act to selectively increase the axial annular flow restriction.

11. The method of claim 8, wherein the tubing string has corrugated tubular intervals, the annulus geometry being selectively controlled by expanding or contracting radially the corrugated tubular intervals upon the application of an axial load, wherein under a compressive axial load, the corrugations can be made to selectively reduce the annulus flow area while the tubing string is disposed in the well bore and upon application of an axial tension load, the corrugations can be made to selectively increase the annulus flow area.

12. The method of claim 1, wherein the annulus geometry is selectively controlled by varying the well bore geometry.

13. The method of claim 1, wherein the tubing string has a capped end.

14. A method for distributing radial fluid flow between a horizontal well bore and a hydrocarbon bearing formation, comprising:

determining that the formation has an axially distributed non-uniform radial flow resistance along a target length of the horizontal well bore;

inserting a tubing string having a sidewall defining a tubing bore into the horizontal well bore, an annulus being defined between the horizontal well bore and the tubing string, the tubing string being provided with ports having a selected distribution and geometry communicating fluid between the tubing bore and the annulus; and controlling the annulus geometry selectively along the length of the tubing string through at least one of axial distribution of eccentricity and flow area of the annulus, so as to provide selected flow restriction characteristics along the annulus, such that when fluid is pumped into the tubing string, a resulting flow resistance network is formed by the tubing bore, the ports, the annulus and the formation, resulting in a desired distribution of radial fluid flow between the well bore and the formation, the annulus geometry being selected on one of the following bases:

to improve the uniformity of distribution of radial flow between the well bore and the formation in the presence of an axially distributed non-uniform radial flow resistance in the formation along the horizontal well bore;

to promote a uniform pressure in the annulus in the presence of an axially distributed non-uniform radial flow resistance in the formation along the horizontal well bore; or to target radial fluid flow into selected formation zones in the presence of an axially distributed non-uniform radial flow resistance in the formation along the horizontal well bore;

wherein the flow restriction characteristics of the ports are non-linear and the port geometry is selected to provide a flow restriction having a positive second derivative of pressure loss with respect to flow rate over a range of sub-critical flow rates, such that when fluid is pumped into the tubing string, a preferential flow from the ports is maintained over a range of pressures and pressurized fluid is injected within the range of sub-critical flow rates.

15. A method for distributing radial fluid flow between a horizontal well bore and a hydrocarbon bearing formation, comprising:

determining that the formation has an axially distributed non-uniform radial flow resistance along a target length of the horizontal well bore;

inserting an injection tubing string having a sidewall defining a tubing bore into the horizontal well bore, an annulus being defined between the horizontal well bore and the tubing string, the tubing string being provided with ports having a selected distribution and geometry communicating fluid between the tubing bore and the annulus; and controlling the annulus geometry selectively along the length of the tubing string through the use of tubular fixturing to provide selected flow restriction characteristics along the annulus, such that when injection fluid is pumped into the tubing string, a resulting flow resistance network is formed by the tubing bore, the ports, the annulus and the formation, resulting in a desired radial distribution of the fluid from the wellbore into the formation, the annulus geometry being selected to improve the uniformity of radial flow distribution in the presence of an axially distributed non-uniform radial flow resistance in the formation along the horizontal well bore.

16. A method for distributing radial fluid flow between a horizontal well bore and a hydrocarbon bearing formation, comprising:

determining that the formation has an axially distributed non-uniform radial flow resistance along a target length of the horizontal well bore;

inserting an injection tubing string having a sidewall defining a tubing bore into the horizontal well bore, an annulus being defined between the horizontal well bore and the tubing string, the tubing string being provided with ports having a selected distribution and geometry communicating fluid between the tubing bore and the annulus; and controlling the annulus geometry selectively along the length of the tubing string through the use of tubular fixturing to provide selected flow restriction characteristics along the annulus, such that when injection fluid is pumped into the tubing, a resulting flow resistance network is formed by the tubing bore, the ports, the annulus and the formation, resulting in a desired radial distribution of the fluid between the wellbore and the formation, the annulus geometry being selected to promote a uniform pressure in the annulus in the presence of an axially distributed non-uniform radial flow resistance in the formation along the horizontal well bore.

17. A method for distributing radial fluid flow between a horizontal well bore and a hydrocarbon bearing formation, comprising:

determining that the formation has an axially distributed non-uniform radial flow resistance along a target length of the horizontal well bore;

inserting an injection tubing string having a sidewall defining a tubing bore into the horizontal well bore, an annulus being defined between the horizontal well bore and the tubing string, the tubing string being provided with ports having a selected distribution and geometry communicating fluid between the tubing bore and the annulus; and controlling the annulus geometry selectively along the length of the tubing string through the use of tubular fixturing to provide selected flow restriction characteristics along the annulus, such that when injection fluid is pumped into the tubing string, a resulting flow resistance network is formed by the tubing bore, the ports, the annulus and the formation, resulting in a desired distribution of radial fluid flow between wellbore and the formation, the annulus geometry being selected to target radial fluid flow into selected formation zones in the presence of an axially distributed non-uniform flow resistance in the formation along the horizontal well bore.

18. A method for distributing radial fluid flow between a horizontal well bore and a hydrocarbon bearing formation, comprising:

determining that the formation has an axially distributed non-uniform radial flow resistance along a target length of the horizontal well bore;

inserting a tubing string having a sidewall defining a tubing bore into the horizontal well bore, an annulus being defined between the horizontal well bore and the tubing string, the tubing string being provided with ports having a selected distribution and geometry communicating fluid between the tubing bore and the annulus; and controlling the annulus geometry selectively along the length of the tubing string through at least one of axial distribution of eccentricity and flow area of the annulus, so as to provide uniformity of distribution of radial fluid flow between the wellbore and the formation in the presence of the axially distributed non-uniform radial flow resistance of the formation through a flow resistance network formed by the tubing bore, the ports, the annulus and the formation.

* * * * *